US006000861A

United States Patent [19]

Zangenfeind et al.

[11] Patent Number: 6,000,861

[45] Date of Patent: Dec. 14, 1999

[54] METHOD OF AND DEVICE FOR TESTING A PHOTOGRAPHIC FILM

[75] Inventors: Helmut Zangenfeind, Puchheim; Reinhart Wuerfel, Munich, both of Germany

[73] Assignee: AGFA-Gevaert Aktiengesellschaft, AG, Leverkusen, Germany

[21] Appl. No.: 09/051,503

[22] PCT Filed: Oct. 11, 1996

[86] PCT No.: PCT/EP96/04444

§ 371 Date: Apr. 10, 1998

§ 102(e) Date: Apr. 10, 1998

[87] PCT Pub. No.: WO97/14098

PCT Pub. Date: Apr. 17, 1997

[30] Foreign Application Priority Data

Oct. 11, 1995 [DE] Germany ..... 195 37 906

[51] Int. Cl.[6] ..... G03D 13/00

[52] U.S. Cl. ..... 396/569; 396/570; 396/632

[58] Field of Search ..... 396/661, 570, 396/567, 569, 632; 355/40, 68, 77

[56] References Cited

U.S. PATENT DOCUMENTS 5,093,686 3/1992 Shigaki ..... 355/77
5,521,662 5/1996 Suzuki ..... 396/661

FOREIGN PATENT DOCUMENTS 0212134 3/1987 European Pat. Off. .
3733468 4/1990 Germany .

*Primary Examiner*—D. Rutledge

[57] ABSTRACT

The invention concerns a method of testing the state of development of a photographic film in a light-proof cartridge. According to the invention, the leading edge of the film is pulled out of the cartridge, the film is positioned between a light source and a photosensor, and the amount of light passing between the light source and photosensor is measured. The state of the film is recognized as being undeveloped if a small amount of light passes therebetween.

13 Claims, 2 Drawing Sheets

METHOD OF AND DEVICE FOR TESTING A PHOTOGRAPHIC FILM

BACKGROUND OF THE INVENTION

The present invention relates to a method and apparatus for testing the state of development of a photographic film, the major portion of which is disposed in a light-proof cartridge but which has a leading end that extends out of the cartridge.

When photographic films are processed in large laboratories, the films are removed from the film cartridges in what is called a splicer and cemented together into a long strip. To do this, the trailing end of one film and the leading end of the subsequent film are positioned in a cementing station in such a way that the ends of the respective films can be joined together with a strip of adhesive. Devices of this genus are described in German Published Application No. 3,833,468 and European Published Application No. 0,212,134, for example. The positioning of the films in the splicing station is usually carried out by means of infrared-light barriers.

U.S. Pat. No. 5,093,686 describes a film system and a laboratory organization wherein the film, after being developed and printed, is rewound back into the cartridge and returned to the customer within the original cartridge along with the finished prints. However, this leads to the problem that the laboratory cannot be certain whether a film cartridge that has been delivered to them contains a film that has not yet been developed or an already developed film from which only repeat orders are to be filled.

A splicer that is suitable for such films can be used in darkroom operation, as has been common in the past, to cement the unexposed films into a strip that is then developed in a developing machine. Such a splicer can, however, also be used in a similar way in lightroom operation to splice together into a strip films that repeat orders are to be filled from, whereupon, however, the strip is not to be developed, but printed. If an error occurs during the sorting of incoming film cartridges, such that, for example, a film that has previously been developed is processed with the as-yet undeveloped films or vice-versa, it can lead to the destruction of the incorrectly sorted film. Whereas a film that has already been developed will fade severely when it is developed again, an as-yet unprocessed film that has been mistakenly included with the previously developed films will be exposed as the result of being processed in the lightroom-operation splicer and accordingly completely ruined.

The U.S. Pat. No. 5,521,662 (not a prior publication) discloses a camera. The description mentions an infrared-transmitting sensor that employs various transmission rates to determine whether the film has been developed.

SUMMARY OF THE INVENTION

A principal object of the present invention is therefore to provide a method of and device for reliably determining very early on in the laboratory whether a particular film has or has not been developed.

This object, as well as other objects which will become apparent from the discussion that follows, are achieved, in accordance with the present invention, by positioning the leading end of the film, which extends out of the cartridge, between the source of light and a photosensor; detecting the presence of the film and measuring the transmission of light between the source of light and the photosensor. The state of the film's development is determined by comparing the result of the detection of the presence of the film with that of the measurement. The point of departure for the invention is that a developed film is practically completely transparent, especially in the infrared range of the spectrum, where most standard light-barrier modules operate. It is accordingly impossible with such an infrared-transmitting light barrier to determine whether there is an already developed film or no film at all between the light source and the photosensor. Another detector must accordingly be employed to determine whether or not there is a film in the film guide. Only once this has been confirmed can an infrared light barrier be employed to determine whether the film is transparent or opaque to infrared light. In the former instance it is a developed film and in the latter, an undeveloped one. The presence of the film can for example be verified with a mechanical sensor mounted such that the leading end of the film wraps around a switch lever. Since, however, this could cause scratches on the film under some conditions, a pneumatic approach is to be preferred. In this approach an air nozzle can be aimed at the film guide and the pressure measured. This pressure will increase abruptly when a film is directly in front of the nozzle's opening. It would also be possible to position an air-pressure sensor on the other side of the film guide to measure the reduction of pressure when a film is traveling between the nozzle and the pressure sensor. A heat-sensitive electric resistor, a resistor, that is, with a resistance that varies with temperature, could alternatively be employed instead of a pressure sensor. When a film is in the guide and no air is blowing against such a resistor, the temperature of the component will increase and its resistance will vary accordingly.

Since the film described in U.S. Pat. No. 5,093,686 for example has a magnetic coat, it is also possible to detect the presence of a firm with a magnetism-detecting head.

It is preferable to determine the presence of a film with a reflected infrared-light barrier. This reasonably priced standard component can be positioned to direct light against the reflective rear surface of the film. With this light barrier it is possible to also detect developed films, which are in themselves infrared-transparent.

Once it has been definitely determined that a film is in the guide, a transmitted infrared-light barrier can be employed to determine whether the film has already been developed. In this event, the two possible states "transparent" and "opaque" are adequate for the determination.

It is, however, also possible to determine the state of development of a film with only one light barrier using light in the green or blue wavelength range (420–580 nm). A particularly appropriate source of light in this event is an LED that emits light at a wavelength of 569 nm. It is possible at this range to definitely distinguish between the three possible states "no film", "undeveloped film", and "developed film". While a nearly 100% transmission of light will be measured in the "no film" state, an undeveloped film will block almost all the light, so that no transmission of light can be measured. A developed film will very definitely be in the range between these two extremes, so that all three states can be well differentiated. Further details and advantages of the present invention will be evident from the subsidiary claims and from a description of one embodiment by way of example, which will now be comprehensively explained with reference to the accompanying drawings.

DESCRIPTION OF THE PREFERRED EMBODIMENTS

Figure 1:
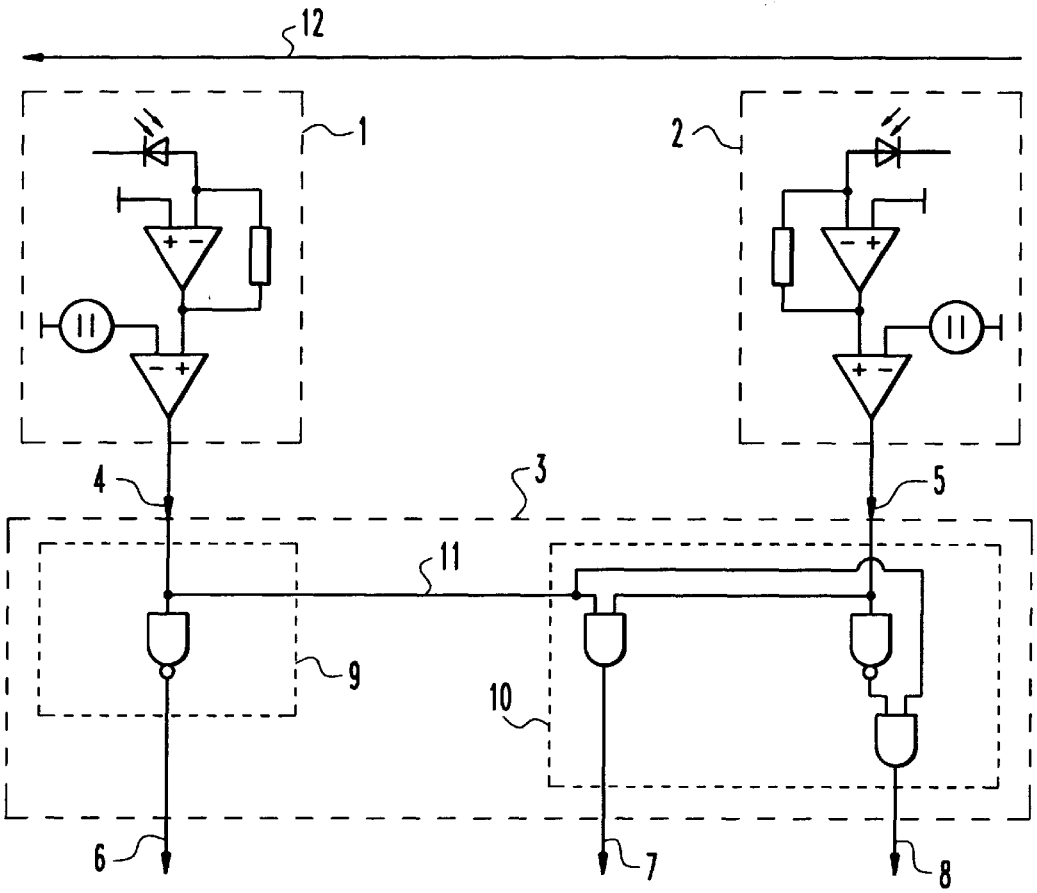
FIG. 1 is a schematic illustration of controls that employ two detectors.

The sensor 1 in FIG. 1 is preferably the photodiode of a reflected infrared-light barrier with a threshold switch designed such that there will be signal present at its input terminal 4 only when the presence of a film in the film guide has been confirmed. Although the light barrier assigned to sensor 2 also operates in the infrared range, it is, in contrast to the reflected infrared-light barrier, designed as a transmitted infrared-light barrier. The threshold switch in sensor 2 is designed such that no signal is present at its input terminal 5 when there is an undeveloped film in the film guide. Controls 3 have two input terminals, an input terminal 4 connected to sensor 1 and an input terminal 5 connected to sensor 2. The controls are also provided with output terminals 6, 7, and 8, which can be employed for specific control purposes. These output terminals are actuated by logic stages 9 and 10.

Figure 3:
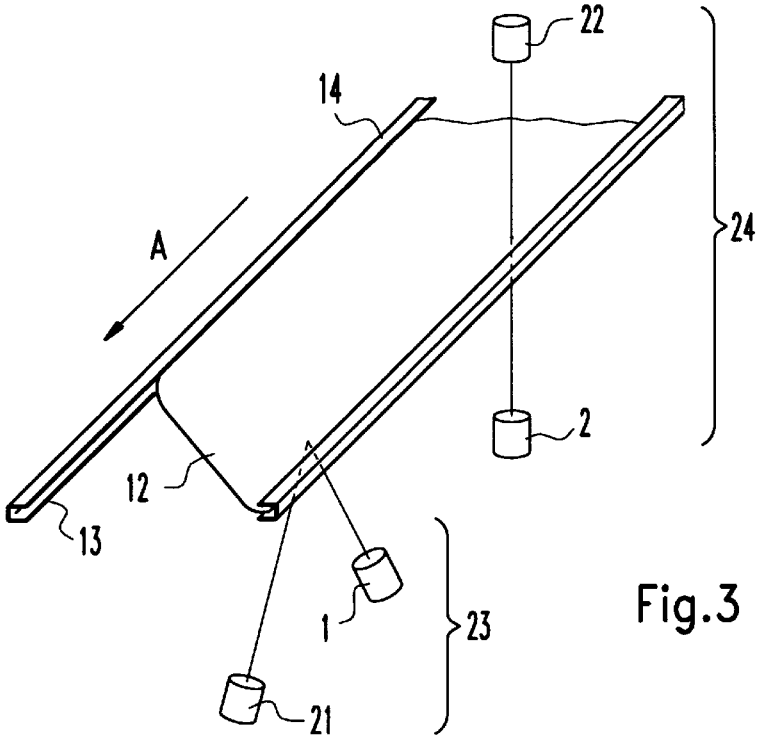
FIG. 3 illustrates a film guide provided with a reflected infrared-light barrier and with a transmitted infrared-light barrier.

FIG. 3 illustrates a film guide with an associated sensing system. Film 12 is advanced through a guide 14 in the direction indicated by arrow A by an unillustrated transport system. A reflected-light barrier 23 comprises a source 21 of light and a photosensor 1, both on the same side of film guide 14. Photosensor 1 consequently receives light only when the light emitted by source 21 is reflected by film 12. A transmitted-light barrier 24 comprises a source 22 of light and a photosensor 2 on opposite sides of the film guide 14. Here, photosensor 2 emits a signal either when there is no film 12 in guide 14 and the light emitted by source 22 reaches sensor 2 directly or when there is an already developed and accordingly infrared-transparent film in the guide.

The logic stage 9 in the controls 3 illustrated in FIG. 1 is designed such that voltage will be applied to output terminal 6 when no signal is present at input 4. As will accordingly be evident from FIG. 3, this means that no film 12 is present in guide 14, or at least that the leading edge 13 of a film 12 has not yet arrived in the vicinity of reflected-light barrier 23.

Light will, however, strike photosensor 1 as soon as film does arrive in this region, and voltage will accordingly be present at input terminal 4. Logic stage 9 will now divert the voltage previously present at output terminal 6 to a connection 11 to logic stage 10. Logic stage 10 is connected to the photosensor 2 in transmitted-light barrier 24 by input terminal 5.

If the film 12 illustrated in FIG. 3 has already been developed, photosensor 2 will receive the light emitted by source 22, because developed films are practically transparent in the infrared range. In this case, a signal will accordingly be present at input terminal 5. If logic stage 10 is accordingly provided with a signal by way of connection 11 and input terminal 5, there will also be a signal at output terminal 7 but no signal at output terminals 6 and 8. If the film 12 is undeveloped and will accordingly have a blocking effect in the infrared range, the photosensor 2 will receive no light and there will be no signal at input terminal 5. In this event (a signal at connection 11 but no signal at input 5), there will be a signal at output terminal 8. In this state there will be no signal at output terminals 6 and 7.

Controls 3 can be considered a logical component with two input and three output terminals. To ensure unambiguous results here, transmitted-light barrier 24 will be ideally positioned where it can act on the edge of the film 12 opposite the reflected-light barrier 23. The switching logic of 3 can be derived from the following table, wherein an "x" represents the presence of signal and an "o" the absence of a signal.

| Input terminal 4 | Input terminal 5 | Output terminal 6 | Output terminal 7 | Output terminal 8 | State |
|---|---|---|---|---|---|
| x | o | o | o | x | Film undeveloped |
| o | x | x | o | o | No film present |
| x | x | o | x | o | Film developed |

Figure 2:
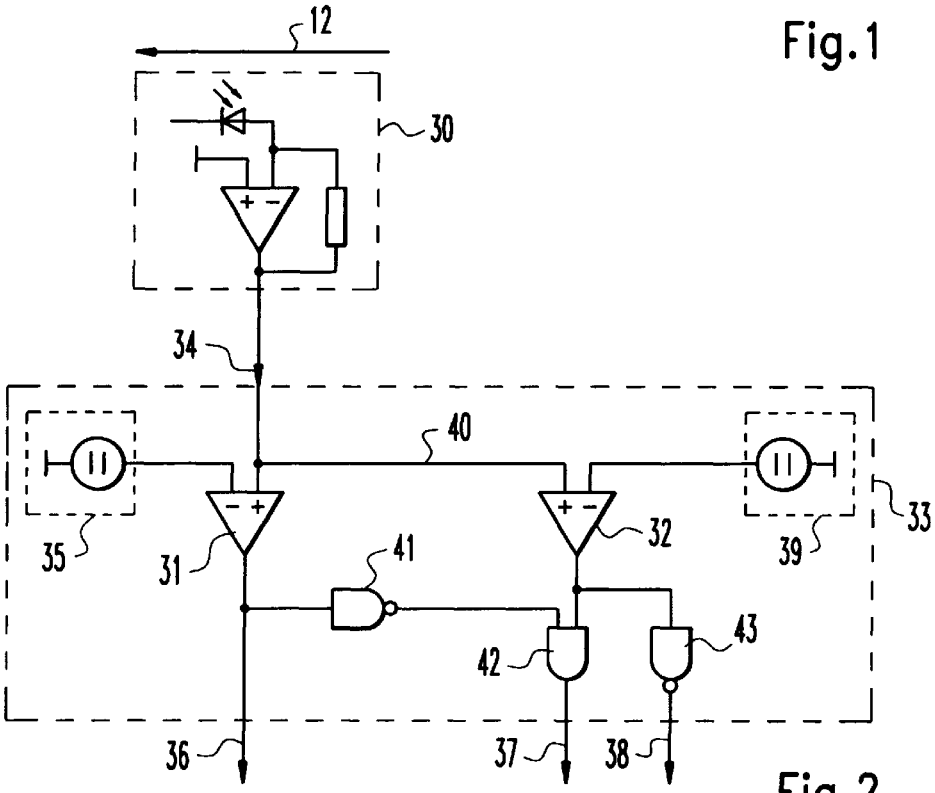
FIG. 2 is a schematic illustration of controls that employ a light barrier.

The embodiment illustrated in FIG. 2 has only one detector, which employs a photosensor 30 operating in the blue-green wavelength range and emitting a signal proportional to the light incident to it. Controls 33, again have three output terminals 36, 37, 38 and accordingly only a single input terminal 34. Controls 33 also include two reference generators 35 and 39 and comparator stages 31 and 32. The signal emitted by reference generator 35 represents approximately 90% of the signal present at input terminal 34 when there is no film in guide 14. The signal emitted by reference generator 39 represents approximately 10% of that signal. Both references can always be adjusted in accordance with the changing output of the detector's source of light.

If the signal present at input terminal 34 is more powerful than the signal emitted by reference generator 35, there will be a signal at output terminal 36. If the signal present at input terminal 34 is weaker than the set-point value, a signal is switched to connection 40. In this event there will also be a signal at the output terminal of comparator stage 32 because the signal obtained from connection 40 will also be more powerful that the signal emitted by reference generator 39. AND stage 42 will accordingly also obtain a signal from comparator stage 32, whereas there will be no signal from NOT stage 41. There will accordingly also be no signal at output terminal 37. Output terminal 38 will also have no signal by way of NOT stage 43.

If there is a developed film in the film guide, the signal at input terminal 34 will be weaker than the signal emitted by reference generator 35 but more powerful than the signal emitted by reference generator 39. No signal will accordingly be forwarded to output terminal 36, although a signal will be present at the output terminal of comparator stage 32. Since a signal from NOT stage 41 will be present at AND stage 42, the latter will forward a signal to output terminal 37. There will again be no signal from NOT stage 43 at output terminal 38.

When there is an undeveloped film in the film guide, the signal at input terminal 34 will be weaker than the signal emitted by reference generator 39. Whereas the situation at the output terminal of comparator stage 31 will accordingly be unchanged, there will no longer be any signal at the output terminal of comparator stage 32, and accordingly no signal at output terminal 37 either, although a signal will have arrived at output terminal 38 by way of NOT stage 43.

To represent the embodiment illustrated in FIG. 3 it will be necessary to eliminate detector 23. The source 22 of light in detector 24 must now be capable of emitting light in the blue-green wavelength range Since a still undeveloped film is sensitive to light within that range and since a latent image of the source of light would be produced on a film tested with a device in accordance with the present embodiment, it would be of advantage to design the source to produce a particular pattern on the film. A laboratory could for example consequently expose an identifying mark onto the leading edge of the film.

Figure 4:
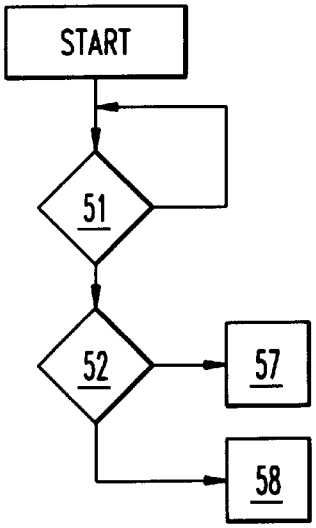
FIG. 4 is a block diagram of a state-detecting system employing two sensors.
Figure 6:
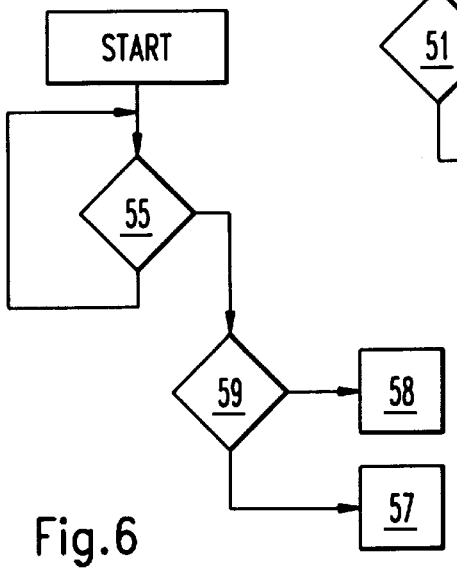
FIG. 6 is a block diagram of a state-detecting system employing only one sensor.
Figure 5:
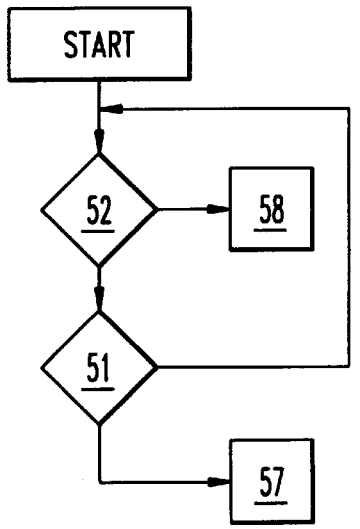
FIG. 5 is another block diagram of a state-detecting system employing two sensors.

The circuits illustrated in FIGS. 1 and 2 could also be realized in the form of software in accordance with the programs illustrated in FIGS. 4 through 6. In this event, the signal 51 emitted by sensor 1 and illustrated in FIG. 4 will be polled. As long as the sensor is emitting no signal, the program will be repeated. Once a signal 51 is detected, the signal 52 emitted by sensor 2 will also be polled. The absence of a signal 52 indicates the presence of a developed film in film guide 14. This decision is represented by reference number 57. A signal at sensor 2 on the other hand will indicate that the detected film is has not yet been developed. The decision is undertaken at reference number 58.

It is alternatively possible for sensor 2 to be polled first, as represented by reference FIG. 52 in FIG. 5. If there is no signal at sensor 2, the presence of an undeveloped film can be immediately decided at 58. If, on the other hand, a signal is present, sensor 1 will be polled again at reference number 51. If no signal is present, no film has at least as yet arrived in the sensor's vicinity. The program is accordingly reset and the polling begins anew. If, on the other hand, there is a signal at sensor 1, a decision can now be made at 57 that a developed film is present.

The block diagram in FIG. 6 represents a device with a sensor and a source of blue-green light. A test is conducted at reference number 55 to determine whether the signal at sensor 2 is more powerful than the threshold, which constitutes about 90% of the signal at sensor 2 when there is no film in the film guide. The signal at sensor 2 being more powerful than the threshold indicates that there is no film in the film guide, and the program is reset. If, on the other hand, the signal at sensor 2 is weaker, it is compared with another threshold at reference number 59. This threshold will constitute only 10% of the signal at sensor 2 as long as there is no film in the film guide. If the signal is more powerful than the threshold, it is decided at 57 that a developed film is present. If the signal is weaker, on the other had, the decision at 58 indicates an undeveloped film.

Various responses can now occur with respect to the confirmed states 57 and 58 or to the signals at output terminals 7 and 8 or 37 and 38. If the testing device is part of a splicer that splices undeveloped films into a long strip so that they can be fed through processing apparatus, the decision "developed film" will initiate rewinding of the film back into the cartridge and closing of the light flap. An appropriate message must also be communicated to the operator that an already developed film has been erroneously loaded. The same response must be triggered in processing apparatus that only develops single films obtained from a cartridge.

If the splicer has been set to process re-orders whereby already developed films have been spliced into a long strip, the "undeveloped film" confirmation must trigger a particular response. In this event, the film must be immediately rewound into the cartridge, because the latent images would be destroyed when exposed to light.

The method and device in accordance with the present invention can be applied not only to the equipment mentioned herein but also in any application where incorrect handling of film, developed or not, could result in irreparable loss to the customer.

There has thus been shown and described a novel method and device for testing a photographic film which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A method of testing the state of development of a photographic film in a light-proof cartridge, comprising the steps of positioning the leading end of the film, which extends out of the cartridge, between a source of light and a photosensor, detecting the presence of the film, and measuring the transmission of light between the source of light and the photosensor.

2. Method as recited in claim 1, wherein the presence of a film is detected with a second detector and the state of the film's development is determined by comparing the result of that detection with that of the measurement.

3. Method as recited in claim 2, wherein the presence of a film is detected mechanically.

4. Method as recited in claim 2, wherein the presence of a film is detected with a reflected infrared-light barrier.

5. Method as recited in claim 4, wherein the reflected infrared light barrier is preferably directed at a surface opposite an emulsion side of the film.

6. Method as recited in claim 2, wherein the measurement is carried out with a transmitted infrared-light barrier.

7. Method as in claim 1, wherein the transmission of light in the green and/or blue wavelength range is measured and the presence of a film is detected and the state of a present film's development determined from how much light is transmitted.

8. Method as recited in claim 2, wherein the presence of a film is detected pneumatically.

9. A device for testing the state of development of a photographic film disposed in a light-proof cartridge, said device comprising a detector for detecting the presence of a film, a source of light and a photosensor for measuring the transmission of light through a section of the film extending out of the cartridge, and control means connected to the photosensor for detecting the presence and state of development of the film on the basis of the incoming signals.

10. Device as recited in claim 9, wherein the control means is coupled to the detector and is operative to detect the following states:

state a: no film present, or state b: film present from the signal leaving the detector, and state c: much light transmitted or state d: little light transmitted from the signal leaving the photosensor and, in the event that states b and c are detected, to recognize the presence of a developed film and, in the event that states b and d are detected, to recognize the presence of an undeveloped film.

11. Device as recited in claim 9, wherein the source of light is a source of infrared light.

12. Device as recited in claim 10, wherein the detector includes a reflected infrared-light barrier.

13. Device as recited in claim 9, wherein the source of light emits light in the blue and/or green wavelength range and wherein the control means is operative to compare the signal leaving the photosensor with prescribed thresholds and differentiates between the following states:

state 1: no film present state 2: developed film present, and state 3: undeveloped film present.

* * * * *